US008306812B2

(12) United States Patent
Cho

(10) Patent No.: US 8,306,812 B2
(45) Date of Patent: Nov. 6, 2012

(54) METHOD AND APPARATUS TO VARY AUDIO PLAYBACK SPEED

(75) Inventor: Jae-youn Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1217 days.

(21) Appl. No.: 11/832,012

(22) Filed: Aug. 1, 2007

(65) Prior Publication Data

US 2008/0162151 A1 Jul. 3, 2008

(30) Foreign Application Priority Data

Dec. 28, 2006 (KR) ..... 10-2006-0136805

(51) Int. Cl.
*G10L 11/00* (2006.01)

(52) U.S. Cl. ..... 704/206

(58) Field of Classification Search ..... 704/200–230
See application file for complete search history.

(56) References Cited

U.S. PATENT DOCUMENTS

| | | | | |
|---|---|---|---|---|
| 5,809,454 | A * | 9/1998 | Okada et al. | 704/214 |
| 5,845,247 | A * | 12/1998 | Miyasaka | 704/267 |
| 5,893,062 | A * | 4/1999 | Bhadkamkar et al. | 704/270 |
| 5,920,842 | A * | 7/1999 | Cooper et al. | 704/503 |
| 6,484,137 | B1 * | 11/2002 | Taniguchi et al. | 704/211 |
| 6,675,141 | B1 * | 1/2004 | Inoue et al. | 704/207 |
| 7,464,028 | B2 * | 12/2008 | Singhal | 704/205 |
| 7,580,833 | B2 * | 8/2009 | Steinberg | 704/218 |
| 2002/0146134 | A1 * | 10/2002 | Gierl et al. | 381/11 |
| 2004/0015347 | A1 * | 1/2004 | Kikuchi | 704/225 |
| 2005/0273321 | A1 * | 12/2005 | Choi | 704/207 |
| 2007/0011343 | A1 * | 1/2007 | Davis et al. | 709/231 |

FOREIGN PATENT DOCUMENTS

| | | |
|---|---|---|
| KR | 2004-13729 | 2/2004 |
| KR | 2006-78183 | 7/2006 |

OTHER PUBLICATIONS

"High Quality Time-Scale Modification for Speech" Salim Roucos and Alexander M. Wilgus, Bolt Beranek and Newman Inc., pp. 493-496.

* cited by examiner

*Primary Examiner* — Abul Azad
(74) *Attorney, Agent, or Firm* — Stanzione & Kim, LLP

(57) ABSTRACT

An audio playback speed control method and apparatus to control an audio playback speed using an optimal frame length with a small amount of calculation. The audio playback method includes extracting an audio sampling frequency and audio playback speed information from an audio signal which is reproduced, determining a length of an input frame, a length of an output frame, and a length of an overlapping region between frames, on a basis of the audio sampling frequency and the audio playback speed information and performing different overlapping and adding methods, according to the audio playback speeds, on a basis of the length of the input frame, the length of the output frame, and the length of the overlapping region between the frames.

19 Claims, 4 Drawing Sheets

METHOD AND APPARATUS TO VARY AUDIO PLAYBACK SPEED

CROSS-REFERENCE TO RELATED APPLICATIONS

This application claims priority under 35 U.S.C. §119 from Korean Patent Application No. 10-2006-0136805, filed on Dec. 28, 2006, in the Korean Intellectual Property Office, the disclosure of which is incorporated herein in its entirety by reference.

BACKGROUND OF THE INVENTION

1. Field of the Invention

The present general inventive concept relates to a digital audio playback system, and more particularly, to an audio playback speed control method and apparatus to control an audio playback speed using an optimal frame length with a small amount of calculation.

2. Description of the Related Art

In general, digital audio playback apparatuses or portable multimedia apparatuses use a time-scale modification technique, such as a Synchronized OverLap-and-Add (SOLA) technique or a Waveform Similarity OverLap-and-Add (WSOLA) technique, in order to control an audio playback speed. The SOLA technique is performed by averaging, overlapping, and adding a frame that is to be modified at a location where a cross-correlation between the frame and a previously modified frame is a maximum.

It is assumed that x(n) denotes an input sound signal and y(n) denotes a time-scale modified signal. Also, it is assumed that N denotes the length of a frame, $S_a$ denotes a frame shift of the input sound signal, and $S_s$ denotes a frame shift of the time-scale modified signal. A modification ratio a is obtained by $S_a/S_s$. Here, if a is greater than 1, the time-scale modification corresponds to time-scale compression, and if a is less than 1, the time-scale modification corresponds to time-scale expansion.

If N samples of the input sound signal x(n) in a period $S_s$ compose the time-scale modified signal y(n) for each period $S_a$, $S_s=S_a/a$ is satisfied.

The SOLA technique duplicates a first frame from x(n) to y(n). An $m^{th}$ input signal $x(mS_a+j)(0 \leqq j \leqq N-1)$ is synchronized with and added to an adjacent time-scale modified signal $y(mS_s+j)$. In order to maximize the cross-correlation between a current frame and a previous frame, the current frame is moved. Therefore, the SOLA technique allows a frame to have its own size of overlapping region in order to modify the time-scale of the input signal without influencing the pitch of the input signal. A normalized cross-correlation coefficient $R_m$ of the SOLA technique in an $m^{th}$ frame is obtained with respect to a frame arrangement offset k of an allowable range as illustrated in Equation 1.

$$R_m(k) = \frac{\sum_{j=0}^{L-1} v(mS_s + k + j)x(mS_a + j)}{\sqrt{\sum_{j=0}^{L-1} x^2(mS_a + j) \sum_{j=0}^{L-1} y^2(mS_s + k + j)}} \quad \text{for} \quad -\frac{N}{2} \le k \le \frac{N}{2}. \qquad \text{[Equation 1]}$$

Here, x(n) denotes an input signal for the time-scale modification, y(n) denotes a time-scale modified signal, m denotes a frame number, and L denotes a length of a region in which x(n) and y(n) overlap.

Therefore, if $R_m$ is determined, y(n) is updated as illustrated in Equation 2.

$$y(mS_s + k_m + j) = \begin{cases} (1 - f(j))y(mS_s + k_m + j) + f(j)x(mS_a + j) & \text{for } 0 \le j \le L_m - 1 \\ x(mS_a + j) & \text{for } L_m \le j \le N - 1. \end{cases} \qquad \text{[Equation 2]}$$

Here, $L_m$ denotes an overlapping region between two signals, in which the determined $R_m$ is included, and f(j) denotes a weighting function resulting in $0 \leqq f(j) \leqq 1$.

However, since the SOLA or WSOLA technique requires a large amount of calculation when a degree of cross-correlation is calculated to control an audio playback speed, it is difficult to apply the SOLA or WSOLA technique to digital audio playback apparatuses using limited hardware resources.

SUMMARY OF THE INVENTION

The present general inventive concept provides an audio playback speed control method to quickly and efficiently vary an audio playback speed through overlapping and adding of frames, without causing pitch and tone variation, when multimedia data is reproduced.

The present general inventive concept also provides an audio playback speed control apparatus to quickly and efficiently vary an audio playback speed using an optimal frame length with a small amount of calculation.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an audio playback speed control method including extracting an audio sampling frequency and audio playback speed information from an audio signal which is reproduced, determining a length of an input frame, a length of an output frame, and a length of an overlapping region between frames, on a basis of the audio sampling frequency and the audio playback speed information and performing different overlapping and adding methods, according to the audio playback speeds, on a basis of the length of the input frame, the length of the output frame, and the length of the overlapping region between the frames.

If the audio playback speed ratio is less than a predetermined value, samples of an overlapping region of a first frame and a second frame are created by associating samples resulting in sequentially increasing sample values obtained by copying a tail portion of the first frame with samples resulting in sequentially decreasing sample values obtained by copying a head portion of the second frame.

If the audio playback speed ratio is greater than a predetermined value, samples of an overlapping region of a first frame and a second frame are created by associating samples obtained by sequentially decreasing sample values of a tail portion of the first frame with samples obtained by sequentially increasing sample values of a head portion of the second frame.

The foregoing and/or other aspects and utilities of the present general inventive concept may also be achieved by providing an audio playback speed control apparatus including an audio decoder unit to extract audio header information and audio data from an audio file, a user interface unit to receive an audio playback speed control command from a user, a controller to extract an audio sampling frequency from the audio header information, and to determine a length of an input frame, a length of an output frame, and a length of an overlapping region between frames, on a basis of the audio sampling frequency and the audio playback speed information; and a playback speed processor to perform different overlapping and adding methods, according to the audio playback speeds, on a basis of the length of the input frame, the length of the output frame, and the length of the overlapping region.

The foregoing and/or other aspects and utilities of the present general inventive concept may also be achieved by providing an audio playback speed control apparatus, including a controller to obtain an audio sampling frequency and audio playback speed information of audio data and a playback speed processor to perform one or more overlapping processes and adding processes of frames of the audio data corresponding to at least one of the obtained audio sampling frequency and audio speed information.

The foregoing and/or other aspects and utilities of the present general inventive concept may also be achieved by providing a method of varying an audio playback speed, the obtaining an audio sampling frequency and audio playback speed information of audio data and performing one or more overlapping processes and adding processes of frames of the audio data corresponding to at least one of the obtained audio sampling frequency and audio speed information.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
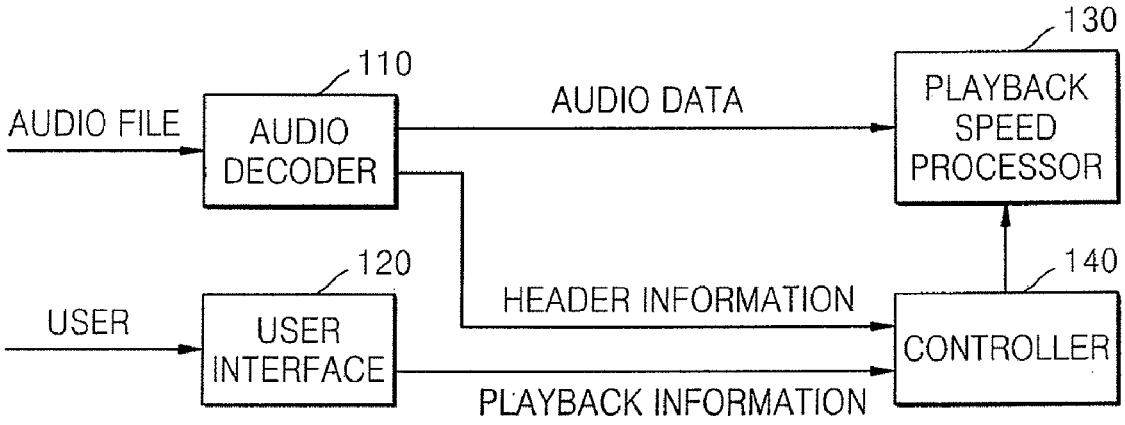
FIG. 1 is a block diagram illustrating an audio playback speed control apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating an audio playback speed control apparatus according to an embodiment of the present general inventive concept.

Referring to FIG. 1, the audio playback speed control apparatus includes an audio decoder 110, a user interface unit 120, a playback speed processor 130, and a controller 140.

The audio decoder 110 extracts header information and audio data from an input audio file.

The user interface unit 120 includes a control panel to allow a user to input a variety of control commands to the audio playback speed control apparatus, and receives audio playback speed information from the user.

The controller 140 receives the header information from the audio decoder 110, receives the audio playback speed information from the user interface unit 120, and extracts an audio sampling frequency from the header information.

Then, the controller 140 determines a length of an input/output frame and a length of an overlapping region between frames, on a basis of the audio sampling frequency and the audio playback speed information.

The playback speed processor 130 performs different overlapping and adding methods, according to the audio playback speeds, on a basis of the length of the input/output frame and the length of the overlapping region.

Figure 2:
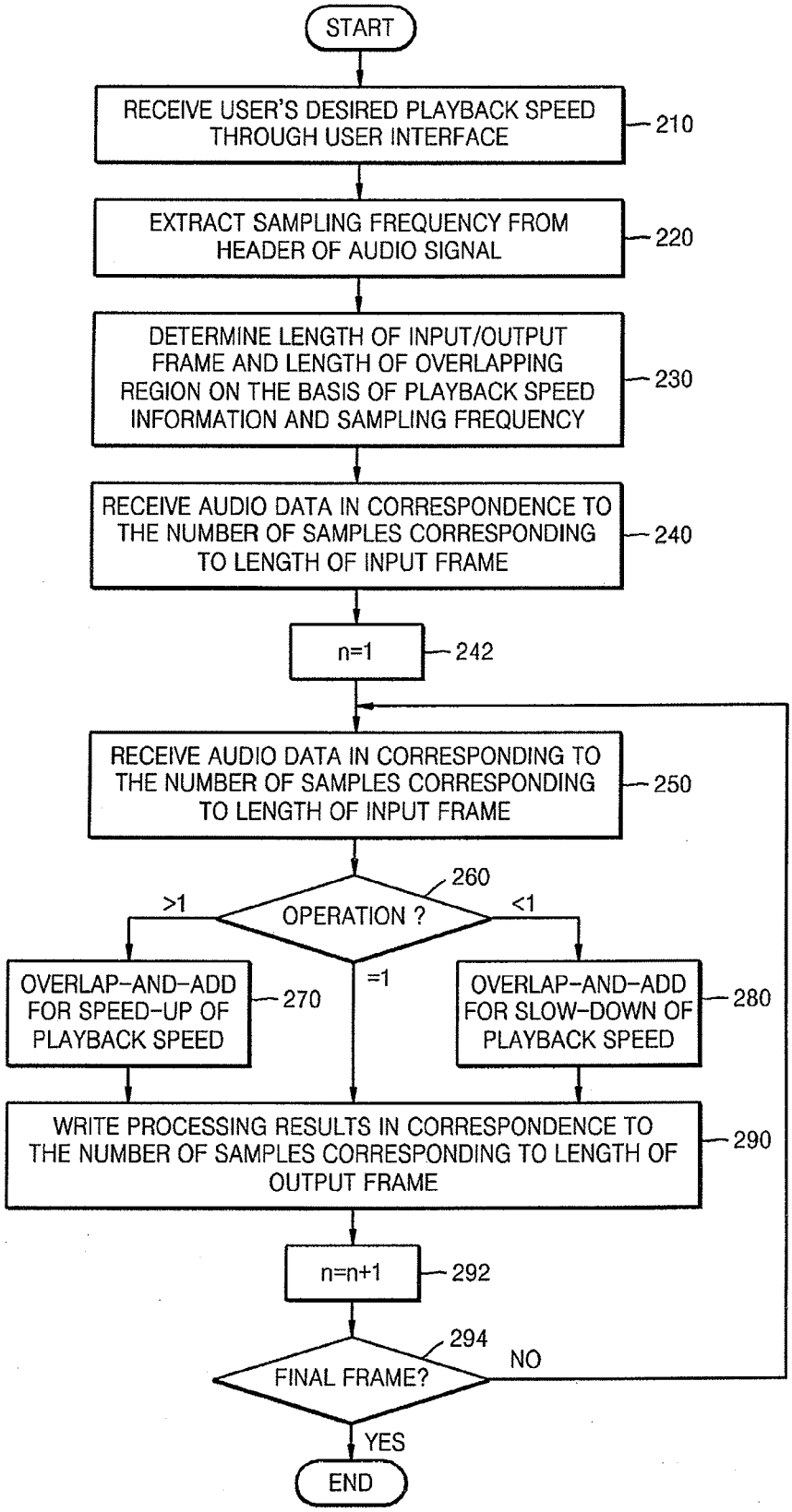
FIG. 2 is a flowchart illustrating an audio playback speed control method according to an embodiment of the present general inventive concept.

FIG. 2 is a flowchart illustrating an audio playback speed control method according to an embodiment of the present general inventive concept.

Unlike the Synchronized OverLap-and-Add (SOLA) technique, the audio playback speed control method does not include a search process, and can reproduce data at a playback speed rate represented by a discrete real number in a range from 0.5 to 2.0.

First, a user's desired playback speed information is received through a user interface (operation 210).

Then header information and audio data are extracted from an input audio file. The input audio file may be multi-channel audio signals or a mono-channel audio signal. If multi-channel audio signals are received, the multi-channel audio signals are converted into a mono-channel audio signal at option.

Next, a sampling frequency is extracted from the header information (operation 220).

Then the length of an input/output frame and the length of an overlapping region between frames are determined on the basis of the playback speed information and the sampling frequency (operation 230). The lengths of the input/output frame and the overlapping region depend on the number of samples.

As a playback speed increases, the sensitivity of human ears with respect to changes in sound pitch relatively deteriorates. Accordingly, the length of the input frame is determined such that the length is within a range that does not change sound pitch characteristics. For example, when a sound signal having a sampling frequency of 44100 Hz is reproduced at a double speed, since a maximum meaningful sound pitch period is 1/60 second, the length of the overlapping region must be longer than the length of 735 (=44100/60) samples. If the length of the overlapping region is determined as a length of 800 samples,_the length of the input frame is determined as a length of 1600 samples and the length of the output frame is determined as a length of 800 samples.

Meanwhile, when a playback speed is close to a normal playback speed, an operation of increasing the length of the input frame such that the length is within a range in which no echo effect occurs, so as to decrease the number of overlapping regions, is performed. Since a phenomenon in which different phonemes overlap occurs if the length of the input frame is too long, in an embodiment of the present general inventive concept, the length of the input frame is less than the length of a minimum meaningful phoneme so that no echo effect occurs.

Also, Equation 1 below is satisfied between the lengths of the input frame and the overlapping region.

$$\text{Length of Overlapping Region}=(|1-\alpha|/\alpha)\times\text{Length of Input Frame}, \quad (1)$$

where a denotes a playback speed rate.

The length of the overlapping region should be longer than a maximum meaningful pitch period.

Next, audio data is received in correspondence to the number of samples corresponding to the length of the input frame, and stored in a buffer (operation 240).

Then, the number n of frames is set to "1" (operation 242).

Then, audio data is received in correspondence to the number of samples corresponding to the length of the input frame, from the buffer (operation 250).

Next, it is determined whether the playback speed is greater than 1 (operation 260).

If the playback speed is greater than 1, an overlapping and adding process to speed-up playback speed is performed using the corresponding length of the overlapping region (operation 270).

If the playback speed is less than 1, an overlapping and adding process to slow-down playback speed is performed using the corresponding length of the overlapping region (operation 280).

Next, the results obtained after the overlapping and adding process to speed-up or slow-down, or the results at a normal playback speed, are written to the buffer in correspondence to the number of samples corresponding to the length of the output frame (operation 290).

Then, the number of frames increases by "1" (operation 292).

Next, it is determined whether a current frame is a final frame (operation 294). If the current frame is a final frame, the process is terminated. If the current frame is not a final frame, the process from operation 250 to operation 294 is repeated.

According to the playback speed control method of the current embodiment, if a playback speed is close to a normal playback speed, an operation of increasing the length of the input frame to decrease the number of overlapping regions is performed. In contrast, if the playback speed is far from the normal playback speed, an operation of decreasing the length of the input frame is performed. Also, if multi-channel audio signals are received, the multi-channel audio signals may be converted into a mono-channel audio signal, a playback speed is accordingly changed, and then the mono-channel audio signal is output to multi-channel speakers. Also, a fast playback speed higher than a double speed can be controlled by repeating the process from operation 210 to operation 294.

Figure 3A:
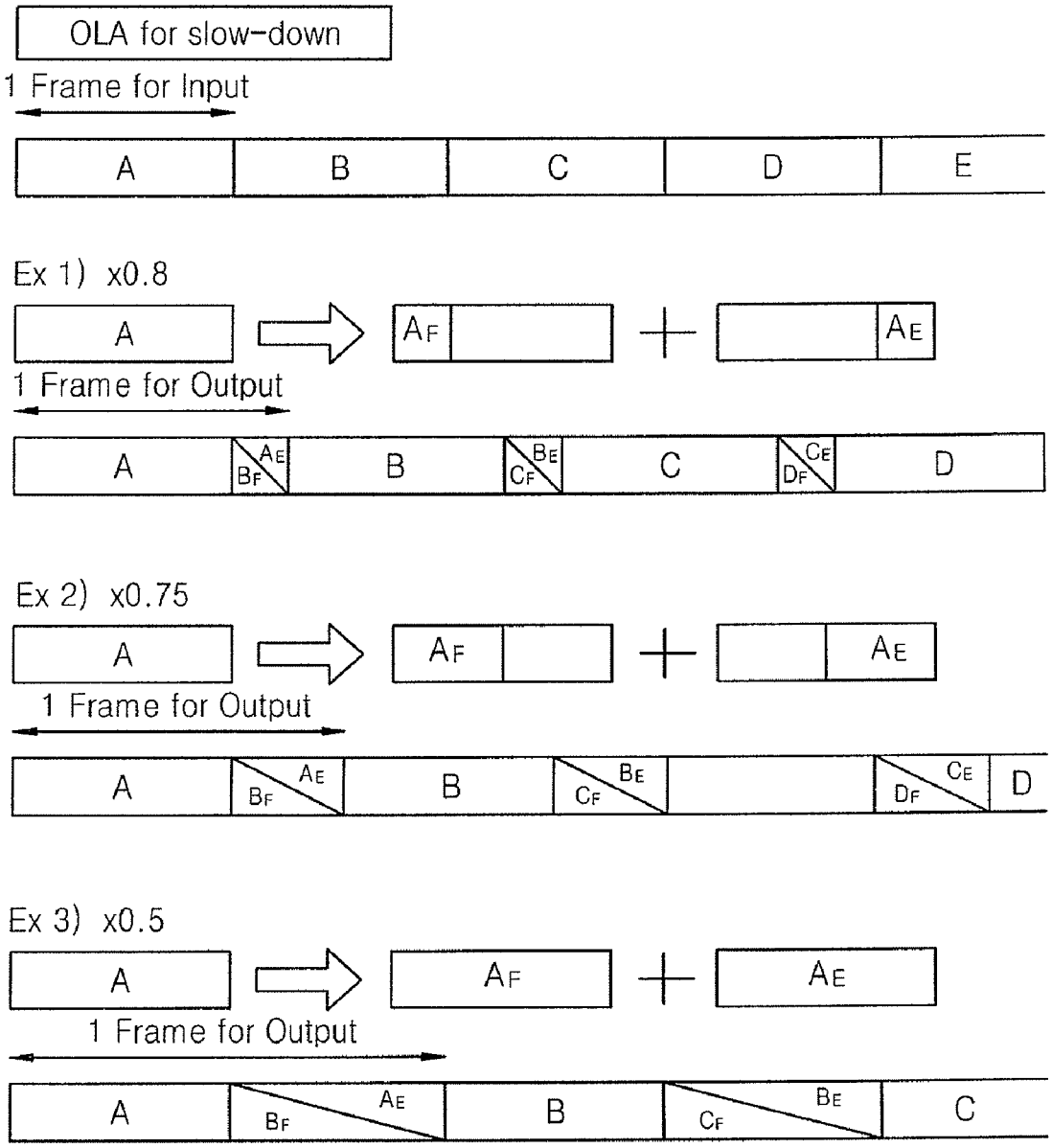
FIG. 3A is a view illustrating in detail a frame overlapping and adding process to slow-down playback speed.

FIG. 3A is a view illustrating in detail the frame overlapping and adding process to slow-down playback speed as described above with reference to FIG. 2.

In FIG. 3A, operations of overlapping and adding input frames A, B, . . . at playback speeds of 0.8, 0.75, and 0.5, respectively, are illustrated.

Referring to FIG. 3A, an output frame includes an input frame period and an overlapping period. A region $B_F/A_E$ where a first input frame A overlaps a second input frame B is created, by associating samples resulting in sequentially decreasing sample values obtained by copying a head portion of the second input frame B, with samples resulting in sequentially increasing sample values obtained by copying a tail portion of the first input frame A.

Alternatively, an overlapping region can be created by extracting sample values of a tail portion of an A frame and sample values of a head portion of a B frame, calculating an average value of the sample values using weighting values, and then inserting the average value between the A frame and the B frame.

According to the frame overlapping and adding process to slow-down playback speed as illustrated in FIG. 3A, it is possible to prevent a sound from being interrupted between frames and thus maintain the continuity of the sound. The length of the overlapping region can be increased or decreased by selectively using a linear window, a sine window, a hamming window, a hanning window, etc. Also, if a playback speed is decreased to a normal playback speed, an operation of increasing the length of an input frame to decrease the number of overlapping regions is performed. Here, by setting the length of the overlapping region to be smaller than the length of a phoneme of an audio signal that is to be processed, sound interruption can be avoided. The phoneme generally includes a plurality of pitch periods. Alternatively, instead of sequentially increasing or decreasing sample values with respect to all frame overlapping regions, a method of sequentially increasing or decreasing sample values with respect to a portion of frame overlapping regions can be used.

Figure 3B:
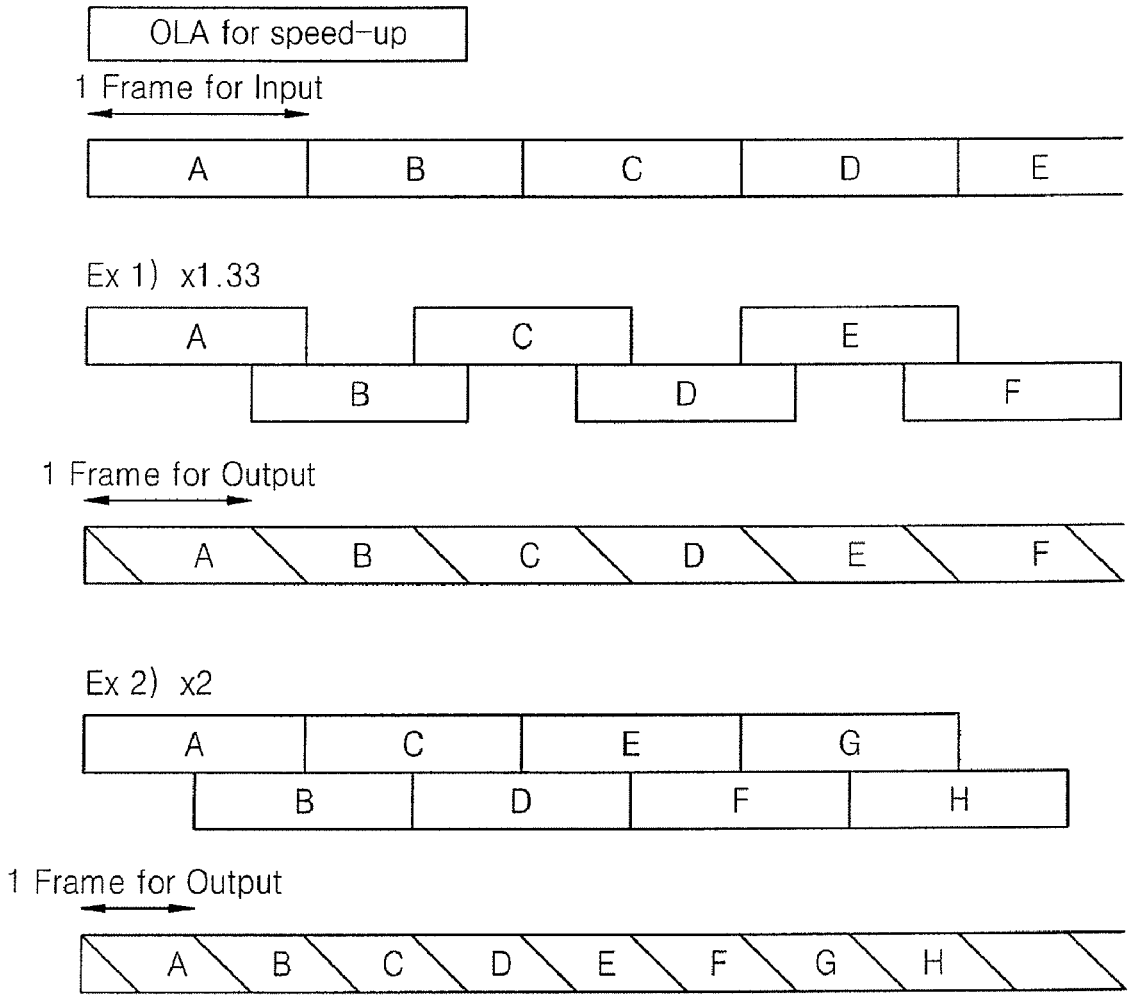
FIG. 3B is a view illustrating in detail a frame overlapping and adding process to speed-up playback speed.

FIG. 3B is a view illustrating in detail the frame overlapping and adding process to speed-up playback speed as described above with reference to FIG. 2.

In FIG. 3B, operations of overlapping and adding input frames A, B, . . . at playback speeds of 1.33 and 2, respectively, are illustrated.

An overlapping region where a first input frame A overlaps a second input frame B is created, by associating samples obtained by sequentially decreasing sample values of a tail portion of a second input frame B, with samples obtained by sequentially increasing sample values of a head portion of a first input frame A. Here, the overlapping region should have a length that can include at least one pitch period, in order to avoid sound interruption.

The present general inventive concept can also be embodied as computer-readable codes on a computer-readable recording medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As described above, according to the present general inventive concept, by setting an optimal frame length according to a sampling frequency and a playback speed, and using different overlapping and adding methods according to playback speeds, when multimedia data is reproduced in mobile phones, PDAs, DTVs, etc., it is possible to quickly and efficiently vary an audio playback speed without causing pitch and tone variation.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An audio playback speed control method, the method comprising:

extracting an audio sampling frequency from an audio signal which is reproduced and receiving audio playback speed information to reproduce the audio signal;

determining a length of an input frame, a length of an output frame, and a length of an overlapping region between frames, on a basis of the audio sampling frequency and the audio playback speed information; and performing different overlapping and adding methods, according to the audio playback speeds, on a basis of the length of the input frame, the length of the output frame, and the length of the overlapping region between the frames, wherein the overlapping region is created by extracting respective sample values of the input frame including a tail portion of a first frame and a head portion of a second frame, calculating an average value of the sample values using weighting values, and inserting the average value between the first frame and the second frame.

2. The method of claim 1, wherein the length of the input frame is obtained by multiplying a value of the sampling frequency by a value of a pitch period.

3. The method of claim 1, wherein the length of the input frame is less than a minimum phoneme length.

4. The method of claim 1, wherein the length of the overlapping region is obtained by multiplying |1-playback speed rate |/playback speed value by the number of samples of an input frame.

5. The method of claim 1, wherein the length of the overlapping region is less than a phoneme length.

6. The method of claim 1, wherein the length of the overlapping region is longer than a pitch period.

7. The method of claim 1, wherein, if a value of the audio playback speed is less than a predetermined value, a value of an overlapping region of the first frame and the second frame is created by associating samples resulting in sequentially increasing sample values obtained by copying a tail portion of the first frame with samples resulting in sequentially decreasing sample values obtained by copying a head portion of the second frame.

8. The method of claim 1, wherein, if a value of the audio playback speed is greater than a predetermined value, a value of an overlapping region of the first frame and the second frame is created by associating samples obtained by sequentially decreasing sample values of a tail portion of the first frame with samples obtained by sequentially increasing sample values of a head portion of the second frame.

9. The method of claim 1, wherein sample values in the overlapping region increase or decrease using a linear function or a nonlinear function.

10. The method of claim 1, wherein sample values in a portion of the overlapping region increase or decrease.

11. The method of claim 1, wherein the overlapping and adding process further comprises:

converting multi-channel audio signals into a mono-channel audio signal; and outputting the mono-channel audio signal to multi-channel speakers.

12. The method of claim 1, wherein the performing different overlapping and adding methods comprises:

performing a first overlapping process and a first adding process of the frames in response to an audio playback speed of the frames exceeding a threshold value; and performing a second overlapping process different from the first overlapping process and a second adding process different from the first adding process of the frames in response to an audio playback speed of the frames being less than the threshold value.

13. The method of claim 12, wherein the first overlapping process and first adding process increase the audio playback speed of the frames and the second overlapping process and the second adding process decrease the audio playback speed of the frames.

14. An audio playback speed control apparatus, comprising:

an audio decoder unit to extract audio header information and audio data from an audio file;

a user interface unit to receive an audio playback speed control command from a user;

a controller to extract an audio sampling frequency from the audio header information, and to determine a length of an input frame, a length of an output frame, and a length of an overlapping region between frames, on a basis of the audio sampling frequency and the audio playback speed information; and a playback speed processor to perform different overlapping and adding methods, according to the audio playback speeds, on a basis of the length of the input frame, the length of the output frame, and the length of the overlapping region, wherein the overlapping region is created by extracting respective sample values of the input frame including a tail portion of a first frame and a head portion of a second frame, calculating an average value of the sample values using weighting values, and inserting the average value between the first frame and the second frame.

15. A non-transitory computer-readable recording medium having embodied thereon a program to execute an audio playback speed control method, the method comprises:

extracting an audio sampling frequency from an audio signal to be reproduced and receiving audio playback speed information to reproduce the audio signal;

determining a length of an input frame, a length of an output frame, and a length of an overlapping region between frames, on a basis of the audio sampling frequency and the audio playback speed information; and performing different overlapping and adding methods, according to the audio playback speeds, on a basis of the length of the input frame, the length of the output frame, and the length of the overlapping region between the frames, wherein the overlapping region is created by extracting respective sample values of the input frame including a tail portion of a first frame and a head portion of a second frame, calculating an average value of the sample values using weighting values, and inserting the average value between the first frame and the second frame.

16. An audio playback speed control apparatus, comprising:

a controller to obtain an audio sampling frequency and audio playback speed information of audio data; and a playback speed processor to perform one or more overlapping processes and adding processes of frames of the audio data corresponding to at least one of the obtained audio sampling frequency and audio speed information, wherein the controller determines a length of an input/output frame and a length of an overlapping region between frames based on the audio sampling frequency and the audio playback speed information, wherein the overlapping region is created by extracting respective sample values of the input/output frame including a tail portion of a first frame and a head portion of a second frame, calculating an average value of the sample values using weighting values, and inserting the average value between the first frame and the second frame.

17. The apparatus of claim 16, further comprising:

a user interface to provide the audio playback speed information to the controller.

18. A method of varying an audio playback speed, the method comprising:

obtaining an audio sampling frequency and audio playback speed information of audio data; and performing one or more overlapping processes and adding processes of frames of the audio data corresponding to at least one of the obtained audio sampling frequency and audio speed information, wherein the controller determines a length of an input/output frame and a length of an overlapping region between frames based on the audio sampling frequency and the audio playback speed information, wherein the overlapping region is created by extracting respective sample values of the input/output frame including a tail portion of a first frame and a head portion of a second frame, calculating an average value of the sample values using weighting values, and inserting the average value between the first frame and the second frame.

19. The method of claim 18, wherein data is reproduced at a playback speed represented by a discrete real number in a range from 0.5 to 2.0.

* * * * *